United States Patent [19]

Mausser

[11] 4,258,413

[45] Mar. 24, 1981

[54] TELESCOPING, TILTABLE LIGHT FIXTURE

[76] Inventor: Victor Mausser, 59-34 Madison St., Ridgewood, N.Y. 11227

[21] Appl. No.: 72,110

[22] Filed: Sep. 4, 1979

[51] Int. Cl.[3] ..... F21V 21/00

[52] U.S. Cl. ..... 362/287; 362/147; 362/269; 362/371; 362/404; 362/427

[58] Field of Search ..... 362/404, 269, 147, 145, 362/148, 150, 151, 270, 275, 285, 287, 371, 372, 406, 418, 427, 804; 339/1 C; 248/240, 240.1

[56] References Cited

U.S. PATENT DOCUMENTS

| | | | |
|---|---|---|---|
| 2,595,011 | 4/1952 | Singer | 362/269 |
| 3,185,837 | 5/1965 | Stern | 362/371 |
| 3,694,649 | 9/1972 | Thompson | 362/390 |
| 3,974,371 | 8/1976 | Miles | 362/372 |
| 4,130,858 | 12/1978 | Hayakawa | 362/404 |
| 4,173,037 | 10/1979 | Henderson | 362/269 |

*Primary Examiner*—Donald P. Walsh
*Attorney, Agent, or Firm*—Charles E. Baxley

[57] ABSTRACT

A telescoping, tiltable light fixture. The fixture comprises a housing for securing to an electrical outlet box and a suspension member secured to the housing. A lamp socket is secured to a socket holder which is slidable and tiltable in the suspension member. Slidable contacts for connecting the socket to an electrical power source are provided in the suspension member and lamp holder.

2 Claims, 7 Drawing Figures

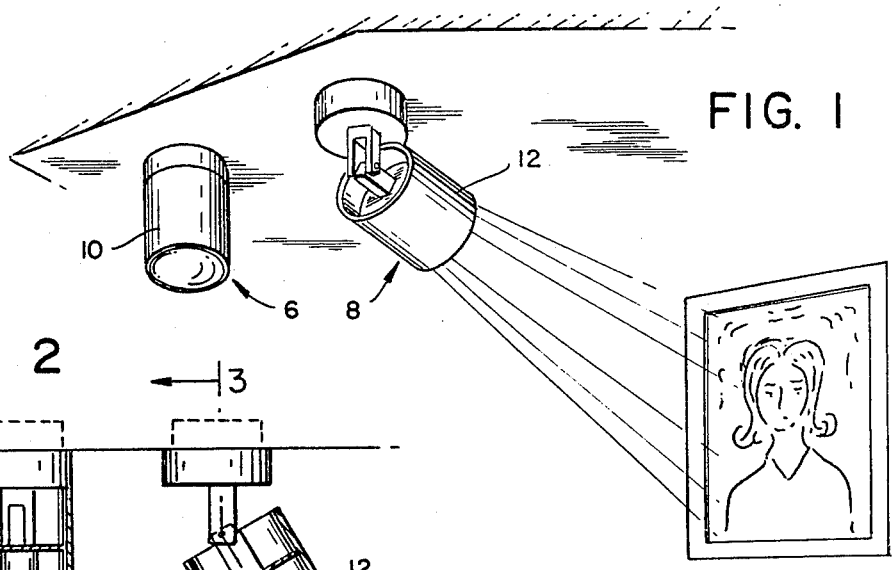
FIG. 1
FIG. 2
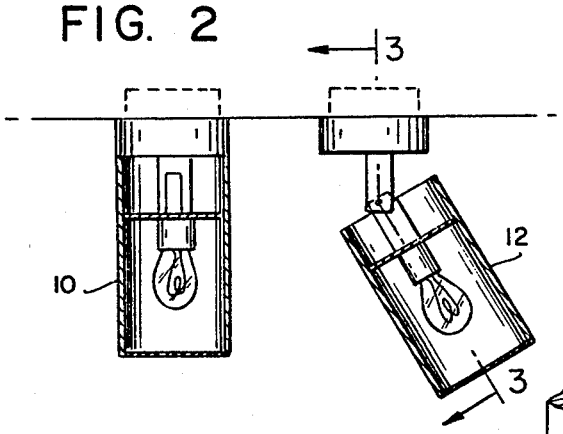
FIG. 5
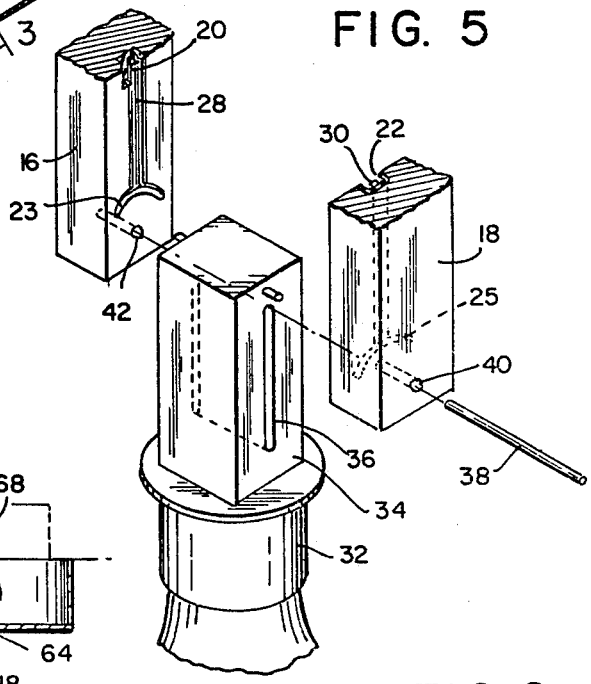
FIG. 4
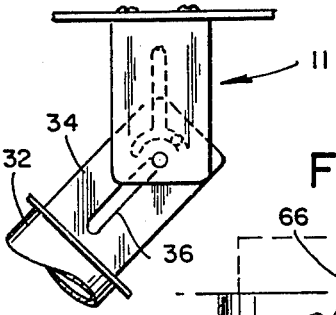
FIG. 3
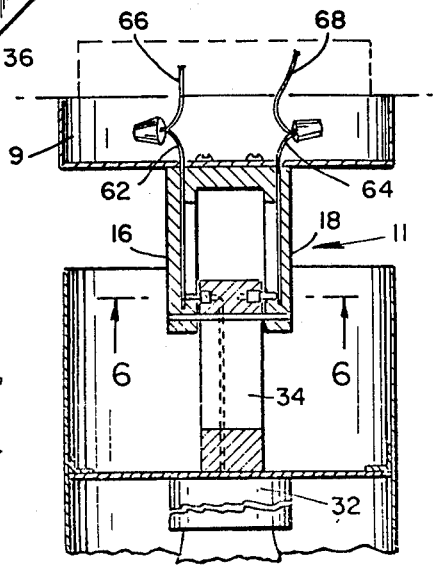
FIG. 7
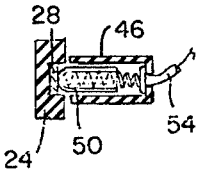
FIG. 6
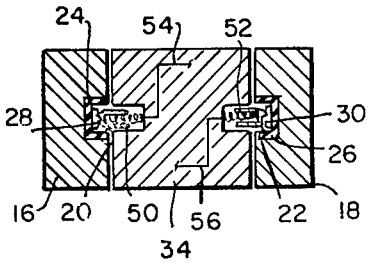

TELESCOPING, TILTABLE LIGHT FIXTURE

BACKGROUND OF THE INVENTION

This application is a refile of application Ser. No. 735,337 of 10/26/76.

Surface cylinder units are commonly used in many of the new fast food restaurants, also stores, theaters, churches, etc.

In order to accent a particular area in a wall, be it a picture, a clock, statue, plants etc., an electrical contractor would have to purchase a separate swivel type spot light which usually looks decade out of style and does not match the surrounding installed fixtures.

The unit, according to the inventor, is harmonious in the uniformity of the fixtures and the electrical contractor need only use a single type of light fixture, thus reducing the cost of such purchases.

After a unit has been used as an accent type of fixture, it can be converted back to a standard type cylinderlite by simply pushing unit up toward the ceiling again. Units can vary in size and wattages, also shapes, such as square, hexagonal, etc.

The sliding mechanism could also be modified to fit some of the current electrified tracks or light-tracks.

The invention relates to electrical light fixtures in general, and in particular to such a fixture which is tiltable and telescoping.

An object of the invention is to provide a light fixture of the above character which may be adjusted to direct a beam of light at a desired angle.

Another object of the invention is to provide a suspension member for the fixture and a lamp socket holder slidable in said suspension member.

A further object of the invention is to provide a device of the above character which is sturdy in construction and economical to manufacture.

These and other objects of the invention will become apparent from the following description in connection with the appended figures, illustrating a preferred embodiment of the invention. It is to be understood, however, that these are given by way of illustration and not of limitation and that changes may be made in the detail, construction, form and size of the parts, without affecting the scope of the invention sought to be protected.

BRIEF DESCRIPTION OF THE DRAWINGS

FIG. 1 illustrates a pair of lighting fixtures in retracted and extended positions;

FIG. 2 is an elevational view of the fixtures 6, 8 shown in FIG. 1 in retracted and extended positions respectively, shades 10, 12 respectively being in cross section;

FIG. 3 is a cross-section taken on line 3—3 of FIG. 2;

FIG. 4 is an enlarged partial elevational view of the mounting member 11 shown in FIG. 3 and in extended position;

FIG. 5 is an exploded perspective view of the mounting member shown in FIG. 4;

FIG. 6 is a section on line 6—6 of FIG. 3; and

FIG. 7 is an enlarged view of a portion of FIG. 6 illustrating the details of the electrical contact used in the device.

DETAILED DESCRIPTION OF INVENTION

Referring now to the drawing in detail, the fixtures 6, 8 according to the invention and identical in construction, are shown in FIG. 1. In the fixture 6, shade 10 is in retracted position, while shade 12 of fixture 8 is in extended, tilted position.

The lighting fixture comprises a housing 9 to which is secured a mounting member 11 consisting of a pair of spaced downwardly extending members 16, 18 of a suitable metal, such as aluminum. A section of the member is shown in FIG. 3.

The members 16, 18 are of rectangular cross-section and are formed with slots or channels 20, 22, lined with insulating material 24, 26, in which are mounted brass contact strips 28, 30. The channels 20, 22 and the insulating material 24, 26 and the contact strips 28, 30 are formed with arcuate end extensions 23, 25, as shown in FIG. 6.

A ceramic lamp socket 32 is secured to an elongated member 34 of rectangular cross-section, which is formed with a longitudinally extending through slot 36. A pin 38 extends through holes 40, 42, in members 16, 18, as well as slot 36, thus acting as a guide for an up and down and inclined sliding movement of member 34 between members 16, 18, as clearly shown in FIG. 6.

Mounted in a pair of insulating sleeves 46, 48, secured in bores 51, 53, of members 34 are a pair of spring-actuated contacts 50, 52, which are electrically connected with lamp socket 32 by insulated wires 54, 56 extending through bores (not shown) in said member. The upper ends of contact strips 28, 30 are provided with wire pigtails 62, 64 by means of which they can be connected with electrical outlet lines 66, 68.

In use, when it is desired to direct the light at an angle, in the position shown by lamp 8 in FIG. 1, shade 10 is slid downward, the member 34 is slid down on pin 38 as far as it will go, until contacts 50, 52 arrive into the arcuate extensions 23, 25, thus making it possible to swing the member 34 to a desired angle. The operation is reversed to return the fixture into the position, as that of lamp 6.

I claim:

1. A telescopic, tiltable light fixture, comprising in combination a housing adapted to be secured to an electrical outlet box, mounting means for the fixture extending downwardly of said housing, a lamp socket, a lamp socket holder secured to said lamp socket and slidable along said mounting means, electrical contact means in said mounting means and in said lamp holder for conducting electrical current to said lamp socket, a shade secured to said socket, said mounting means comprising a pair of spaced downwardly extending members, said lamp holder having a longitudinal through slot, a pivot pin extending through said pair of downwardly extending members and through said lamp socket holder, said members being formed with longitudinal channels having arcuate end portion and lined with insulating material liners, brass contact strips in said liners, respectively, wire pigtails secured to the ends of said brass strips for connecting to an electrical power source, said lamp socket holder including said contact means cooperating with said brass contact strips and electrically connected to said lamp socket.

2. The device as claimed in claim 1, said electrical contact means in said lamp holder consisting of a pair of sleeves of insulating material embedded in opposite sides of said lamp holder, a pair of contacts in said sleeves and a pair of springs, respectively, biasing said contacts against said brass strips, and insulated wires secured to said contacts and extending through said lamp socket holders for connecting said contacts to said lamp holder.

* * * * *